US011079121B2

(12) United States Patent
Li et al.

(10) Patent No.: US 11,079,121 B2
(45) Date of Patent: Aug. 3, 2021

(54) MUFFLER FOR A REFRIGERATION SYSTEM AND THE REFRIGERATION SYSTEM

(71) Applicant: Carrier Corporation, Palm Beach Gardens, FL (US)

(72) Inventors: Hongyi Li, Zhejiang (CN); Yuling Shi, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/637,212

(22) PCT Filed: Aug. 8, 2018

(86) PCT No.: PCT/US2018/045776

§ 371 (c)(1),
(2) Date: Feb. 6, 2020

(87) PCT Pub. No.: WO2019/032681

PCT Pub. Date: Feb. 14, 2019

(65) Prior Publication Data

US 2020/0224893 A1 Jul. 16, 2020

(30) Foreign Application Priority Data

Aug. 9, 2017 (CN) ..... 201710674826.X

(51) Int. Cl.
*F24F 1/12* (2011.01)

(52) U.S. Cl.
CPC ..... *F24F 1/12* (2013.01); *F25B 2500/12* (2013.01); *F25B 2500/13* (2013.01)

(58) Field of Classification Search
CPC ..... F24F 1/12; F25B 2500/12; F25B 2500/13; F01N 2310/02; F01N 2470/04;
(Continued)

(56) References Cited

U.S. PATENT DOCUMENTS 3,602,333 A * 8/1971 Kobayashi ..... F01B 31/16 181/252
4,375,841 A 3/1983 Vielbig
(Continued)

FOREIGN PATENT DOCUMENTS

CN 2272526 Y 1/1998
CN 202165328 U 3/2012
(Continued)

OTHER PUBLICATIONS

Miloud et all, Turbulent flow computation in a circular U-Bend, Mar. 25, 2014, EPJ Web of Conferences vol. 67, 2014, EFM13—Experimental Fluid Mechanics 2013 (Year: 2014).*
(Continued)

*Primary Examiner* — Steve S Tanenbaum
(74) *Attorney, Agent, or Firm* — Cantor Colburn LLP

(57) ABSTRACT

Provided in the present invention are a muffler (2) for use in a refrigerating device and a refrigerating device. The muffler comprises an outer casing (23), an inner wall (24), and a sound absorbing material (26) provided between the inner wall and the outer casing, the inner wall defining a fluid inlet (21), a fluid outlet (22), and a fluid passage deflected between the fluid inlet and the fluid outlet, wherein at least a partial region of the inner wall is provided with perforations (241, 242, 243, 244), and the inner wall has a higher perforation rate at the inner side of the fluid passage than that at the outer side of the fluid passage. The muffler according to the embodiment of the present invention significantly reduces the sound and vibration of the refrigerating device.

13 Claims, 1 Drawing Sheet

(58) Field of Classification Search
CPC .... F01N 1/24; F04D 29/4206; F04D 29/4213; F04D 29/664
USPC ..... 62/296
See application file for complete search history.

(56) References Cited

U.S. PATENT DOCUMENTS

| | | | | |
|---|---|---|---|---|
| 5,784,784 | A | 7/1998 | Flanigan et al. | |
| 5,881,554 | A | 3/1999 | Novak et al. | |
| 6,524,080 | B1 | 2/2003 | Chintamani et al. | |
| 7,753,167 | B2 | 7/2010 | Fukano et al. | |
| 7,794,213 | B2 | 9/2010 | Gaude et al. | |
| 7,993,112 | B2 | 8/2011 | Rockwell | |
| 8,016,071 | B1 | 9/2011 | Martinus et al. | |
| 8,197,188 | B2 | 6/2012 | Clay et al. | |
| 8,276,398 | B2 * | 10/2012 | Grabon | F25B 43/02 62/296 |
| 8,307,943 | B2 | 11/2012 | Klasing et al. | |
| 2003/0118762 | A1 * | 6/2003 | Brown | F02C 7/24 428/36.1 |
| 2008/0179134 | A1 | 7/2008 | Grabon et al. | |
| 2009/0078499 | A1 * | 3/2009 | Sikes | F01N 13/1805 181/256 |

FOREIGN PATENT DOCUMENTS

| | | | |
|---|---|---|---|
| CN | 103343846 | A | 10/2013 |
| CN | 104832247 | A | 8/2015 |
| CN | 105201784 | A | 12/2015 |
| DE | 19608273 | A1 | 9/1997 |

OTHER PUBLICATIONS

International Search Report and Written Opinion for application PCT/US2018/045776, dated Oct. 16, 2018, 11 pages.

* cited by examiner

MUFFLER FOR A REFRIGERATION SYSTEM AND THE REFRIGERATION SYSTEM

TECHNICAL FIELD

The present invention relates to the technical field of refrigerating devices, and more particularly, to a muffler in a refrigerating device.

BACKGROUND ART

For refrigerating devices, such as a centrifugal refrigerating device, both noise and vibration level are important factors. When the degree of opening of an inlet guide vane (IGV) of a compressor is relatively small, the noise and vibration level of the centrifugal refrigerating device are relatively high, whereby the user experience is affected.

SUMMARY OF THE INVENTION

An object of the invention is to solve or at least alleviate the problems existing in the prior art.

In another aspect, an object of the invention is also to improve the noise and vibration level of a refrigerating device.

In still another aspect, an object of the present invention is to provide a muffler downstream of a compressor, which does not substantially affect the performance of the compressor.

Provided is a muffler for use in a refrigerating device, comprising an outer casing, an inner wall, and a sound absorbing material provided between the inner wall and the outer casing, the inner wall defining a fluid inlet, a fluid outlet, and a fluid passage deflected between the fluid inlet and the fluid outlet, wherein at least a partial region of the inner wall is provided with perforations, and the inner wall has a higher perforation rate at the inner side of the fluid passage than that at the outer side of the fluid passage.

Further provided is a refrigerating device, comprising a muffler in accordance with various embodiments of the present invention.

BRIEF DESCRIPTION OF THE DRAWINGS

The principles of the present invention will become more apparent by reading the following detailed description with reference to the accompanying drawings, in which.

DETAILED DESCRIPTION

It will be readily appreciated that multiple alternative constructions and implementation manners may be suggested by a person of ordinary skill in the art in accordance with the technical solutions of the present invention without departing from the spirit of the invention. Therefore, the following particular embodiments and accompanied drawings are merely exemplary explanation of the technical solutions of the present invention, and should not be considered as the entirety of the present invention or as a definition or limitation to the technical solutions of the present invention.

Orientation phases such as "up", "down", "left", "right", "front", "rear", "front side", "back side", "top", "bottom" or the like mentioned or may be mentioned in the description are defined relative to the constructions shown in the various accompanying drawings, are relative concepts, and therefore may accordingly be varied according to their different locations and different usage stages. Therefore, these or other orientation phases should not be construed as limiting either.

Figure 1:
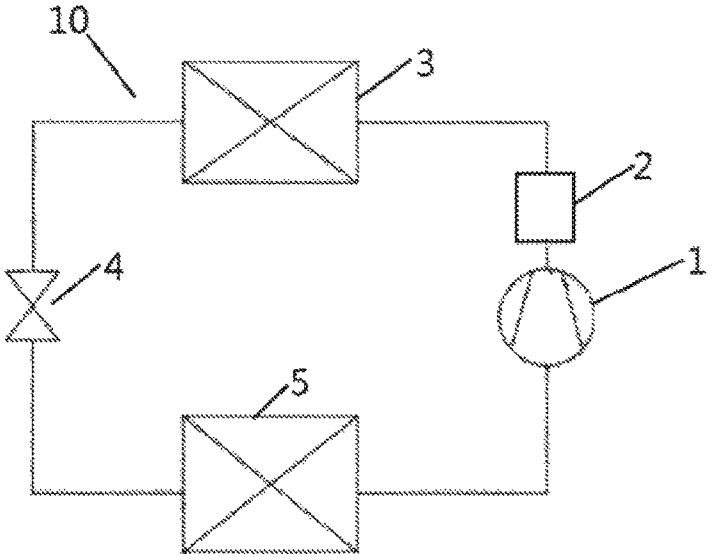
FIG. 1 shows a schematic structural view of a refrigerating device.

FIG. 1 shows a schematic structural view of a refrigerating device 10. It should be understood that in this schematic view, various components of the refrigerating device 10 are omitted. The refrigerating device 10 comprises a compressor 1, a muffler 2 downstream of the compressor 1, a condenser 3 downstream of the muffler 2, a throttling device 4 such as a throttle valve downstream of the condenser 3, and an evaporator 5 downstream of the throttling device 4, the evaporator 5 being in turn connected to a gas suction port of the compressor 1. The compressor 1, the condenser 3, the throttling device 4 and the evaporator 6 together form a loop. The muffler 2 is arranged between the compressor 1 and the condenser 3 in order to reduce the sound and vibration of the entire refrigerating device 10.

Figure 2:
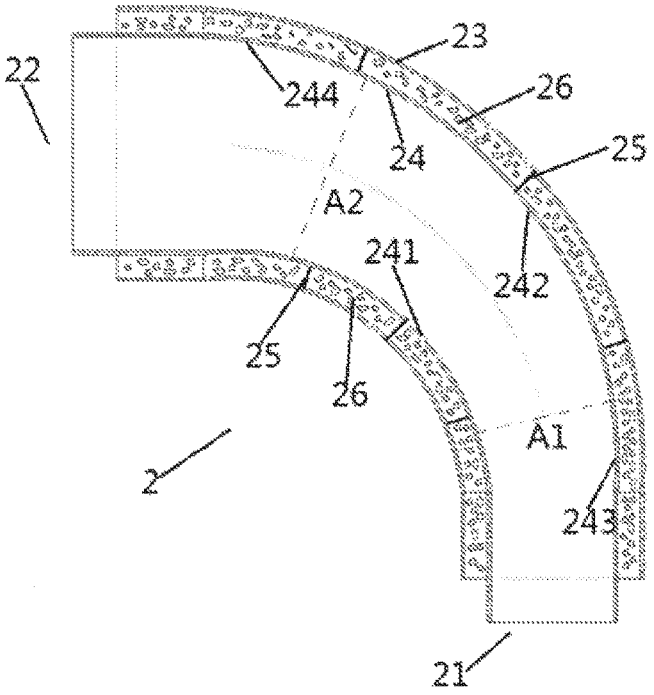
FIG. 2 shows a cross-sectional view of a muffler according to the present invention.

FIG. 2 shows a cross-sectional view of a muffler 2 according to an embodiment. The muffler comprises an outer casing 23, an inner wall 24, and a sound absorbing material 26 arranged between the inner wall 24 and the outer casing 23, the inner wall 24 defining a fluid inlet 21, a fluid outlet 22, and a fluid passage deflected between the fluid inlet 21 and the fluid outlet 22, wherein at least a partial region of the inner wall 24 is provided with perforations, and the inner wall 24 has a higher perforation rate at the inner side 241 of the fluid passage than that at the outer side 242, 243, 244 of the fluid passage.

The muffler according to the embodiment has the deflected fluid passage to accommodate the arrangement inside the refrigerating device 10 so as to be connectable between the compressor 1 and the condenser 3. In some embodiments, the fluid inlet 21 of the muffler 2 is directly connected to a compressed gas outlet of the compressor 1, and/or the fluid outlet 22 of the muffler 2 is directly connected to an inlet of the condenser 3. Therefore, the compressor 1 and the condenser 3 can be directly connected via the muffler 2. In some embodiments, the fluid passage may be deflected in the form of an arc as shown in the figure. In other embodiments, the fluid passage may also be composed of two or three straight fluid passage segments which form an angle to achieve the deflection, or may be deflected in any other suitable manner. In some embodiments, the fluid passage is deflected in the range of 75 degrees to 105 degrees, in other words, the fluid passage covers a central angle of 75 degrees to 105 degrees, or the fluid passage is deflected in the range of 80 degrees to 100 degrees, or the fluid passage is deflected in the range of 85 degrees to 95 degrees, or the fluid passage is deflected for approximately 90 degrees. In the case that the fluid passage is deflected for approximately 90 degrees, the fluid inlet 21 is substantially perpendicular to the fluid outlet 22, and this design can accommodate the arrangement of the compressor and the condenser in some typical refrigerating devices.

The perforation rate of the inner wall of the muffler according to the embodiment varies depending on the flow rate of the fluid around the inner wall. In general, a lower perforation rate is used at locations where the flow rate of the surrounding fluid is higher, and vice versa. More specifically, since the outer side 242, 243, 244 of the fluid passage of the inner wall is directly impacted by the fluid from the fluid inlet 21, a lower perforation rate is used, so as to prevent turbulence and associated secondary noises, and protect the sound absorbing material from being damaged. On the contrary, the flow rate of the fluid around the inner side 241 of the fluid passage of the inner wall is lower, so a higher perforation rate can be used. It should be understood that the inner side of the deflected fluid passage refers to the side closer to the center of curvature, and the outer side of the deflected fluid passage refers to the side further away from the center of curvature. In some embodiments, the perforation rate of the inner wall 24 at the inner side 241 of the fluid passage is in the range of 10-20%, or in the range of 12-18%, or in the range of 14-16%, or approximately 12%. In some embodiments, the perforation rate of the inner wall 24, particularly at the outer side 242, 243, 244 of the fluid passage, also varies along the length of the fluid passage. In some embodiments, the inner wall at the outer side of the fluid passage comprises two end portions 243, 244 near the fluid inlet and the fluid outlet and a middle portion 242 between the two end portions 243, 244, the inner wall at the outer side of the fluid passage having a larger perforation rate at the two end portions 243, 244 than that at the middle portion 242. In some embodiments, the two end portions 243, 244 of the fluid passage may, for example, occupy ⅕ to ⅓, such as ¼, of the length of the entire fluid passage. In some embodiments, the perforation rate of the inner wall at the middle portion 242 of the outer side of the fluid passage may be in the range of 0-5%, or in the range of 0-3%, or even substantially free of perforations, i.e., the perforation rate is 0%. In some embodiments, the perforation rate of the inner wall at the two end portions 243, 244 of the outer side of the fluid passage may be in the range of 5-10%, or in the range of 7-9%, or approximately 8%.

Furthermore, the fluid passage may have a larger cross-sectional area at the fluid outlet 22 than that at the fluid inlet 21. In some embodiments, the cross-sectional area of the fluid passage gradually increases from the fluid inlet 21 to the fluid outlet 22, i.e., the cross-sectional area of any downstream section A2 of the fluid passage is greater than the cross-sectional area of the upstream section A1. The gradually increasing cross-sectional area allows the dynamic pressure of the fluid compressed by the compressor 1 to be partially converted into static pressure. It should be understood that the static pressure is desirable in the refrigerating device. Therefore, the muffler 2 affects the performance of the entire refrigerating device as little as possible, or basically does not affect the performance of the entire refrigerating device.

In addition, in some embodiments, the outer casing 23 of the muffler may be made of a metal material such as steel or another alloy, the inner wall of the muffler may also be made of a metal material such as stainless steel or another alloy, and the sound absorbing material 26 may be made of glass fiber or another suitable material. In some embodiments, in order to prevent the sound absorbing material 26 from moving between the outer casing 23 and the inner wall in the length direction of the muffler due to the air flow, a partition wall 25 may be provided between the outer casing 23 and the inner wall. The partition wall 25 may be substantially ring-shaped. The partition wall 25 is used to partition the sound absorbing material, and more specifically, the partition wall 25 may be oriented substantially in a direction perpendicular to the outer casing 23 and the inner wall, and divide a sound absorbing material receiving cavity between the outer casing and the inner wall of the muffler into multiple separated chambers, thereby preventing the movement of the sound absorbing material 26.

It has been found by experiments that the sound and vibration of a refrigerating device equipped with the muffler in accordance with the various embodiments of the present application are significantly reduced. In a preferred case, the sound is reduced by 8 dBA and the vibration of the condenser is reduced by about 60 percent.

It should be understood that all the above preferred embodiments are illustrative and not restrictive, and various modifications or variations made by a person skilled in the art to the particular embodiments described above under the concept of the present invention should be within the scope of legal protection of the present invention.

The invention claimed is:

1. A muffler for use in a refrigerating device, comprising an outer casing, an inner wall, and a sound absorbing material provided between the inner wall and the outer casing, the inner wall defining a fluid inlet, a fluid outlet, and a fluid passage deflected between the fluid inlet and the fluid outlet, wherein at least a partial region of the inner wall is provided with perforations, and the inner wall has a higher perforation rate at the inner side of the fluid passage than that at the outer side of the fluid passage.

2. The muffler according to claim 1, wherein the inner wall defines the fluid passage deflected in the form of an arc.

3. The muffler according to claim 1, wherein the fluid passage is deflected in the range of 75 degrees to 105 degrees.

4. The muffler according to claim 1, wherein the fluid passage has a larger cross-sectional area at the fluid outlet than that at the fluid inlet, the cross-sectional area of the fluid passage gradually increasing from the fluid inlet to the fluid outlet.

5. The muffler according to claim 1, wherein the outer casing and the inner wall are made of a metal material, and the sound absorbing material is glass fiber.

6. The muffler according to claim 1, wherein a plurality of partition walls for partitioning the sound absorbing material are provided between the outer casing and the inner wall.

7. The muffler according to claim 1, wherein the inner wall at the outer side of the fluid passage comprises two end portions near the fluid inlet and the fluid outlet and a middle portion between the two end portions, the inner wall at the outer side of the fluid passage having a larger perforation rate at the two end portions than that at the middle portion.

8. The muffler according to claim 7, wherein the perforation rate of the inner wall at the two end portions of the outer side of the fluid passage is in the range of 5-10%.

9. The muffler according to claim 7, wherein the perforation rate of the inner wall at the middle portion of the outer side of the fluid passage is in the range of 0-5%.

10. The muffler according to claim 7, wherein the perforation rate of the inner wall at the inner side of the fluid passage is in the range of 10-20%.

11. A refrigerating device, comprising the muffler as claimed in claim 1.

12. The refrigerating device according to claim 11, comprising a compressor, a condenser, a throttling device, and an evaporator which form a loop, wherein the muffler is arranged between the compressor and the condenser.

13. The refrigerating device according to claim 11, wherein the fluid inlet of the muffler is directly connected to an outlet of the compressor, and/or the fluid outlet of the muffler is directly connected to an inlet of the condenser.

* * * * *